US010325711B2

(12) United States Patent
Hamada et al.

(10) Patent No.: US 10,325,711 B2
(45) Date of Patent: Jun. 18, 2019

(54) COIL COMPONENT

(71) Applicant: Murata Manufacturing Co., Ltd., Kyoto (JP)

(72) Inventors: Akinori Hamada, Nagaokakyo (JP); Yoshimasa Yoshioka, Nagaokakyo (JP); Kenji Nishiyama, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 15/401,164

(22) Filed: Jan. 9, 2017

(65) Prior Publication Data

US 2017/0207020 A1 Jul. 20, 2017

(30) Foreign Application Priority Data

Jan. 20, 2016 (JP) ..... 2016-008993

(51) Int. Cl.
*H01F 5/00* (2006.01)
*H01F 17/00* (2006.01)
*H01F 27/29* (2006.01)

(52) U.S. Cl.
CPC ..... *H01F 17/0033* (2013.01); *H01F 17/0013* (2013.01); *H01F 27/292* (2013.01); *H01F 2017/002* (2013.01)

(58) Field of Classification Search
None
See application file for complete search history.

(56) References Cited

U.S. PATENT DOCUMENTS 8,089,331 B2 * 1/2012 Jacobson ..... H01F 27/2804 336/200
2008/0094166 A1 * 4/2008 Hsu ..... H01F 27/2804 336/223
2016/0276095 A1 * 9/2016 Zabaco ..... H01F 17/0013

FOREIGN PATENT DOCUMENTS

JP H08-69935 A 3/1996
JP 2002-280230 A 9/2002
(Continued)

OTHER PUBLICATIONS

An Office Action; "Notification of Reasons for Refusal," Mailed by the Japanese Patent Office dated Jul. 31, 2018, which corresponds to Japanese Patent Application No. 2016-008993 and is related to U.S. Appl. No. 15/401,164; with English language translation.
(Continued)

*Primary Examiner* — Ronald Hinson
(74) *Attorney, Agent, or Firm* — Studebaker & Brackett PC

(57) ABSTRACT

A coil component: including a first planar spiral wiring and a second planar spiral wiring located above the first planar spiral wiring in a laminated direction and interconnected through connection vias to the first planar spiral wiring. The second planar spiral wiring is wound in a direction different from a winding direction of the first planar spiral wiring when viewed in the laminated direction. The first planar spiral wiring and the second planar spiral wiring have respective innermost circumferential overlapping portions overlapping with each other at the innermost circumferential region when viewed in the laminated direction. At least both end parts of the innermost circumferential overlapping portion of the first planar spiral wiring are in an interconnection with at least both end parts of the innermost circumferential overlapping portion of the second planar spiral wiring through the connection vias.

7 Claims, 9 Drawing Sheets

(56) References Cited

FOREIGN PATENT DOCUMENTS

| | | | |
|---|---|---|---|
| JP | 2013-225718 | A | 10/2013 |
| JP | 2014-199914 | A | 10/2014 |

OTHER PUBLICATIONS

An Office Action; "Notification of Reasons for Refusal," Mailed by the Japanese Patent Office dated Feb. 5, 2019, which corresponds to Japanese Patent Application No. 2016-008993 and is related to U.S. Appl. No. 15/401,164; with English language translation.

* cited by examiner

COIL COMPONENT

CROSS REFERENCE TO RELATED APPLICATIONS

This application claims benefit of priority to Japanese Patent Application 2016-008993 filed Jan. 20, 2016, the entire content of which is incorporated herein by reference.

TECHNICAL FIELD

The present disclosure relates to a coil component. Specifically, the present disclosure relates to a laminated coil component.

BACKGROUND

Conventional laminated coil components employ a form in which one planar spiral wiring wound in one direction is in an interconnection with another planar spiral wiring wound in a direction opposite to the one direction through a connection via along a laminated direction. Japanese Laid-Open Patent Publication No. 2013-225718 discloses a laminated coil component. In the laminated coil component, an inner circumferential end of the one planar spiral wiring is in the interconnection with an inner circumferential end of another planar spiral wiring through one connection via.

SUMMARY

Problem to be Solved by the Disclosure

However, when an inner circumferential end of one planar spiral wiring 101 is in interconnection with an inner circumferential end of another planar spiral wiring 102 through one connection via 103 along a laminated direction as shown in FIG. 9, a connection-reliability may not be sufficient.

It is therefore an object of an aspect of the present disclosure to provide a coil component capable of improving the connection-reliability between one planar spiral wiring and another planar spiral wiring disposed along the laminated direction.

Solutions to the Problems

To solve the problem, an aspect of the present disclosure provides, a coil component comprising:

a first planar spiral wiring; and a second planar spiral wiring located above the first planar spiral wiring in a laminated direction and interconnected through connection vias to the first planar spiral wiring, wherein the second planar spiral wiring is wound in a direction different from a winding direction of the first planar spiral wiring when viewed in the laminated direction, wherein the first planar spiral wiring and the second planar spiral wiring have respective innermost circumferential overlapping portions overlapping with each other at the innermost circumferential region when viewed in the laminated direction, and wherein at least both end parts of the innermost circumferential overlapping portion of the first planar spiral wiring are in an interconnection with at least both end parts of the innermost circumferential overlapping portion of the second planar spiral wiring through the connection vias.

In the coil component of the aspect, at least both end parts of the innermost circumferential overlapping portion of the first planar spiral wiring are in the interconnection with at least both end parts of the innermost circumferential overlapping portion of the second planar spiral wiring through the connection vias, the innermost circumferential overlapping portion of the first planar spiral wiring and the innermost circumferential overlapping portion of the second planar spiral wiring overlapping with each other when viewed in the laminated direction. Thus, the innermost circumferential overlapping portion of the first planar spiral wiring is in the interconnection with the innermost circumferential overlapping portion of the second planar spiral wiring through two connection vias, which results in increased connection points as compared to the case of connecting the inner circumferential ends with each other through one connection via. Therefore, the connection-reliability between the first planar spiral wiring and the second planar spiral wiring can be improved without substantially changing the number of turns, the outermost circumferential diameter, the number of layers, etc. of these planar spiral wirings.

In an embodiment, one of end parts of the respective innermost circumferential overlapping portions of the first planar spiral wiring and the second planar spiral wiring are positioned at portions wound by a half circumference from other of end parts of the respective innermost circumferential overlapping portions of the first planar spiral wiring and the second planar spiral wiring.

Therefore, as compared to a conventional form of an interconnection between an inner circumferential end of one planar spiral wiring and an inner circumferential end of the other planar spiral wiring through one connection via along the laminated direction, the planar spiral wirings each have one fourth of the circumference additionally wound at the innermost circumferential region. As a result, the regions of the innermost circumferential overlapping portions of the planar spiral wirings can be enlarged while ensuring sufficient wiring distances. Therefore, regions for connecting the innermost circumferential overlapping portions with each other through a plurality of connection vias can be ensured. Thus, the connection-reliability can be improved between the first planar spiral wiring and the second planar spiral wiring.

In an embodiment, the innermost circumferential overlapping portion of the first planar spiral wiring between both end parts is in an interconnection with the innermost circumferential overlapping portion of the second planar spiral wiring between both end parts through one or more further connection vias. As a result, in addition to both end parts of the innermost circumferential overlapping portion of the first planar spiral wiring and both end parts of the innermost circumferential overlapping portion of the second planar spiral wiring, the innermost circumferential overlapping portion of the first planar spiral wiring between both end parts is in the interconnection with the innermost circumferential overlapping portion of the second planar spiral wiring between both end parts through the connection vias. Therefore, the connection points can be further increased between the first planar spiral wiring and the second planar spiral wiring. Thus, the connection-reliability can be further improved between the first planar spiral wiring and the second planar spiral wiring.

In an embodiment, an entire region of the innermost circumferential overlapping portion of the first planar spiral wiring is in an interconnection with an entire region of the innermost circumferential overlapping portion of the second planar spiral wiring through a connection via.

In other words, the connection via is filled between the innermost circumferential overlapping portion of the first planar spiral wiring and the innermost circumferential overlapping portion of the second planar spiral wiring. Therefore, a region of connection provided between the first planar spiral wiring and the second planar spiral wiring can be increased. Thus, the connection-reliability can be further improved between the first planar spiral wiring and the second planar spiral wiring.

In an embodiment, the coil component further comprises a magnetic core part extending in a winding center part of the first planar spiral wiring and a winding center part of the second planar spiral wiring. When the magnetic core part is made of a material with a high permeability, the inductance of the coil component can be increased.

In an embodiment, a width dimension of the innermost circumferential overlapping portion of the first planar spiral wiring is smaller than that of the portion other than the innermost circumferential overlapping portion of the first planar spiral wiring, and wherein a width dimension of the innermost circumferential overlapping portion of the second planar spiral wiring is smaller than a width dimension of the portion other than the innermost circumferential overlapping portion of the second planar spiral wiring. As a result, the regions of the winding center parts can be enlarged in the first planar spiral wiring and the second planar spiral wiring. Therefore, the magnetic core part extending in the winding center parts of the first planar spiral wiring and the second planar spiral wiring can be enlarged. Thus, the inductance of the coil component can be increased.

In an embodiment, a width dimension of the innermost circumferential overlapping portion of the first planar spiral wiring is smaller than the width dimension of a portion other than the innermost circumferential overlapping portion of the first planar spiral wiring, and an outer edge of the innermost circumferential overlapping portion of the first planar spiral wiring continues without unevenness to an outer edge of the portion other than the innermost circumferential overlapping portion of the first planar spiral wiring. Additionally, a width dimension of the innermost circumferential overlapping portion of the second planar spiral wiring is smaller than that of the portion other than the innermost circumferential overlapping portion of the second planar spiral wiring, and an outer edge of the innermost circumferential overlapping portion of the second planar spiral wiring continues without unevenness to an outer edge of the portion other than the innermost circumferential overlapping portion of the second planar spiral wiring.

As a result, the inner edges of the innermost circumferential overlapping portions of the first planar spiral wiring can be made discontinuous from the inner edges of other than the innermost circumferential overlapping portions of the first planar spiral wiring, and the inner edges of the innermost circumferential overlapping portions of the second planar spiral wiring can be also made discontinuous from the inner edges of other than the innermost circumferential overlapping portions of the second planar spiral wiring. Therefore, regions bulging outward can respectively be formed at the inner edge regions of the innermost circumferential overlapping portions of the first planar spiral wiring and the second planar spiral wiring. Thus, when the coil component further comprises the magnetic core part extending in the winding center part of the first planar spiral wiring and the winding center part of the second planar spiral wiring, the diameter of the magnetic core part can be increased by the bulges of the regions. Consequently, the inductance of the coil component can be increased.

Effect of the Disclosure

According to the coil component of the aspects, the connection-reliability can be improved between the first planar spiral wiring and the second planar spiral wiring.

DETAILED DESCRIPTION

A coil component related to a plurality of embodiments according to an aspect of the present disclosure will now be described with reference to the drawings.

In this description, a "laminated direction" refers to a direction in which layers are layered. A "first planar spiral wiring" and a "second planar spiral wiring" refer to spirally wound wirings. In this description, a "planar spiral wiring is wound in a different direction" refers to a state in which, for example, one planar spiral wiring is wound clockwise from the outside to the inside (or from the inside to the outside) while the other planar spiral wiring is wound counterclockwise. It is noted that not only when wirings completely overlap in the linewidth direction but also when wirings partially overlap in the linewidth direction, this overlapping portion may be regarded as an innermost circumferential overlapping portion.

First Embodiment

First, a coil component 1 related to a first embodiment according to an aspect of the present disclosure will be described with reference to FIGS. 1 to 3B.

Figure 1:
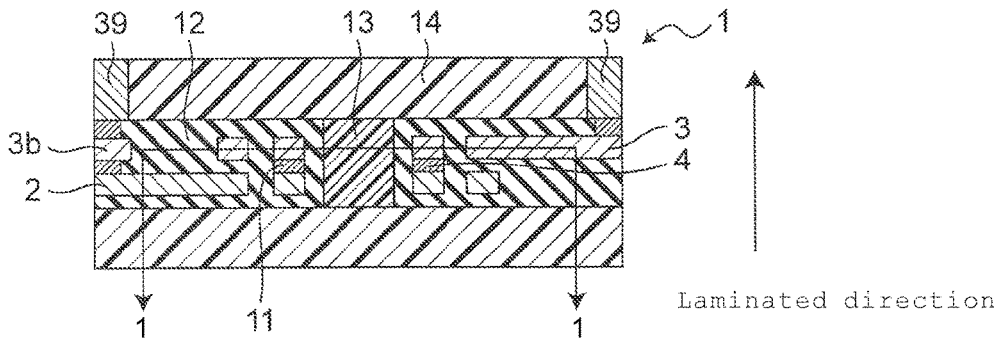
FIG. 1 is a schematic cross-sectional view of a coil component according to an embodiment.
Figure 2:
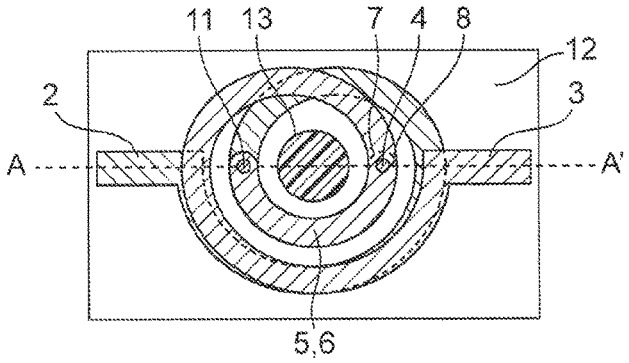
FIG. 2 is a schematic plan view of a form in which both end parts of an innermost circumferential overlapping portion of a first planar spiral wiring are in an interconnection with both end parts of an innermost circumferential overlapping portion of a second planar spiral wiring through connection vias, the innermost circumferential overlapping portion of the first planar spiral wiring and the innermost circumferential overlapping portion of the second planar spiral wiring overlapping with each other when viewed in a laminated direction in a line segment 1-1 shown in FIG. 1.
Figure 3A:
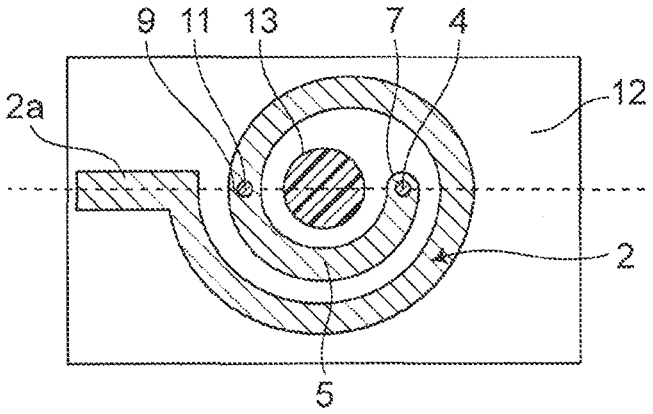
FIG. 3A is a schematic plan view of a form in which connection vias are disposed in both end parts of the innermost circumferential overlapping portion of the first planar spiral wiring.
Figure 3B:
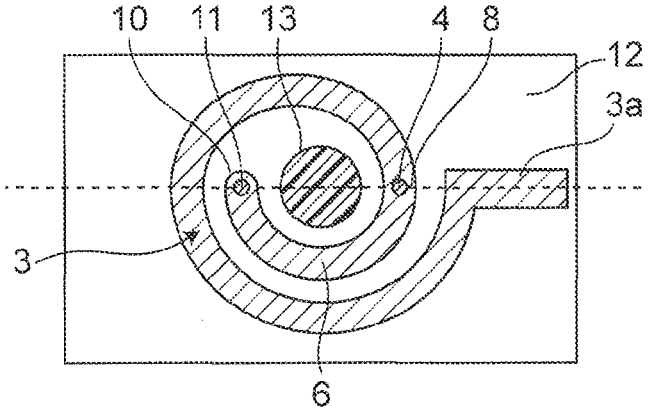
FIG. 3B is a schematic plan view of a form in which connection vias are disposed in both end parts of the innermost circumferential overlapping portion of the second planar spiral wiring.

FIG. 1 is a schematic cross-sectional view of a coil component related to an embodiment. FIG. 2 is a schematic plan view of a form in which both end parts of an innermost circumferential overlapping portion of a first planar spiral wiring are in an interconnection with both end parts of an innermost circumferential overlapping portion of a second planar spiral wiring through connection vias, the innermost circumferential overlapping portion of the first planar spiral wiring and the innermost circumferential overlapping portion of the second planar spiral wiring overlapping with each other when viewed in a laminated direction in a line segment 1-1 shown in FIG. 1. FIG. 3A is a schematic plan view of a form in which connection vias are disposed in both end parts of the innermost circumferential overlapping portion of the first planar spiral wiring. FIG. 3B is a schematic plan view of a form in which connection vias are disposed in both end parts of the innermost circumferential overlapping portion of the second planar spiral wiring.

The coil component 1 related to the first embodiment can be used in an electronic device such as a smartphone and a car navigation of an automobile, for example. The coil component 1 related to the first embodiment includes a first planar spiral wiring 2 and a second planar spiral wiring 3 disposed in an insulating layer 12 as shown in FIG. 1. As shown in FIGS. 1 and 2, a magnetic core part 13 is disposed to extend in a winding center part of the first planar spiral wiring 2 and a winding center part of the second planar spiral wiring 3. As shown in FIG. 1, the magnetic core part 13 is disposed such that both end parts thereof are respectively connected to magnetic body layers 14. The first planar spiral wiring 2 and the second planar spiral wiring 3 are disposed such that the second planar spiral wiring 3 is located above the first planar spiral wiring 2 along the laminated direction and the winding center parts of the first planar spiral wiring 2 and the second planar spiral wiring 3 overlap with each other. As shown in FIGS. 3A and 3B, the first and second planar spiral wirings 2, 3 have lead parts 2*a*, 3*a* led out linearly from outer circumferential ends with spiral shapes. As shown in FIG. 1, the coil component 1 includes a pair of external terminals 39 as terminals for an external connection. One of the external terminals 39 is electrically connected through a connection via to a lead part 3*b* electrically connected to the lead part 2*a* of the first planar spiral wiring 2, and the other external terminal 39 is electrically connected through a connection via to the lead part 3*a* of the second planar spiral wiring 3. Although disposed in the same layer, the second planar spiral wiring 3 and the lead part 3*b* are not connected in this layer.

The second planar spiral wiring 3 (see FIG. 3B) is in the interconnection with the first planar spiral wiring 2 (see FIG. 3A) through connection vias along the laminated direction. The first planar spiral wiring 2 and the second planar spiral wiring 3 are each wound more than n times (n: natural number) and less than n+1 times. Therefore, each of the inner circumferential ends of the first planar spiral wiring 2 and the second planar spiral wiring 3 is located in a portion at which they are wound more than n times (n: natural number) and less than n+1 times. Specifically, in the coil component 1, the first planar spiral wiring 2 is wound 1.5 times counterclockwise from the outside to the inside as shown in FIG. 3A. In the coil component 1, the second planar spiral wiring 3 is wound 1.5 times clockwise from the outside to the inside as shown in FIG. 3B. Portions 5, 6 corresponding to portions respectively wound by a half circumference from end parts 7, 10 at the innermost circumferential regions of the first planar spiral wiring 2 and the second planar spiral wiring 3 are positioned such that the distance between the first planar spiral wiring 2 and the magnetic core part 13 substantially becomes equal to the distance between the second planar spiral wiring 3 and the magnetic core part 13. Additionally, the first planar spiral wiring 2 and the second planar spiral wiring 3 respectively have width dimensions which are equal over their entire circumferences and they respectively have the width dimensions which are equal to each other.

In this case, as shown in FIG. 2, the portion 5 of the first planar spiral wiring 2 and the portion 6 of the second planar spiral wiring 3 form innermost circumferential overlapping portions substantially overlapping with each other at the innermost circumferential region when viewed in the laminated direction. Therefore, in the coil component 1, the first planar spiral wiring 2 and the second planar spiral wiring 3 have the respective innermost circumferential overlapping portions 5, 6.

Figure 9:
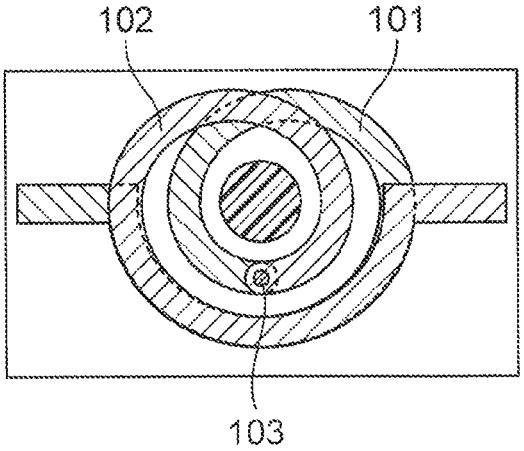
FIG. 9 is a schematic plan view of a conventional coil component.

As described above, in the first embodiment, one of the end parts of the respective innermost circumferential overlapping portions 5, 6 of the first planar spiral wiring 2 and the second planar spiral wiring 3 are positioned at portions wound by a half circumference from the other of the end parts of the respective innermost circumferential overlapping portions 5, 6 of the first planar spiral wiring 2 and the second planar spiral wiring 3. Therefore, as compared to a conventional form in which the inner circumferential end of one planar spiral wiring 101 is in the interconnection with the inner circumferential end of the other planar spiral wiring 102 through one connection via 103 along the laminated direction as shown in FIG. 9, the first and second planar spiral wirings 2, 3 of the coil component 1 each have one fourth of the circumference additionally wound at the innermost circumferential region. In this case, the regions of the innermost circumferential overlapping portions 5, 6 of the planar spiral wirings 2, 3 can be enlarged while ensuring the wiring distances to the planar spiral wirings 2, 3 located immediately outside.

In the first embodiment, as shown in FIG. 2, the first end part 7 of the first planar spiral wiring 2 forming the one of the end parts of the innermost circumferential overlapping portion 5 is in the interconnection with the first end part 8 of the second planar spiral wiring 3 forming the one of the end parts of the innermost circumferential overlapping portion 6 through a first connection via 4. The second end part 9 of the first planar spiral wiring 2 forming the other of the end parts of the innermost circumferential overlapping portion 5 is in the interconnection with the second end part 10 of the second planar spiral wiring 3 forming the other of the end parts of the innermost circumferential overlapping portion 6 through a second connection via 11. Therefore, the two end parts 7, 9 of the innermost circumferential overlapping portion 5 of the first planar spiral wiring 2 are in the interconnection with the two end parts 8, 10 of the innermost circumferential overlapping portion 6 of the second planar spiral wiring 3 through the two connection vias 4, 11. This results in increased connection points as compared to a case where the inner circumferential ends are interconnected through the one connection via 103 as shown in FIG. 9. Therefore, as compared to the conventional case where the inner circumferential end of a planar spiral wiring 101 is in the interconnection with the inner circumferential end of a planar spiral wiring 102 through the one connection via 103, the planar spiral wiring 101 and a planar spiral wiring 102 being laminated with each other, the connection-reliability can be improved between the first planar spiral wiring 2 and the second planar spiral wiring 3.

Additionally, since the innermost circumferential overlapping portion 5 of the planar spiral wirings 2 is in the interconnection with the innermost circumferential overlapping portion 6 of the planar spiral wirings 3 through the two connection vias 4, 11 in the coil component 1, the innermost circumferential regions of the first and second spiral wirings 2, 3 are extended along the respective winding directions as compared to the conventional case where the inner circumferential end of the planar spiral wiring 101 is in the interconnection with the planar spiral wiring 102 through the one connection via 103 along the laminated direction. As a result, when viewed in the laminated direction, the planar spiral wirings 2, 3 are doubled in the innermost circumferential overlapping portions 5, 6. Additionally, the width dimensions of the innermost circumferential overlapping portions 5, 6 of the first and second planar spiral wirings 2, 3 are equal to those of the portions other than the innermost circumferential overlapping portions 5, 6 of the first and second spiral wirings 2, 3. As a result, the cross-sectional areas are substantially increased in the innermost circumferential overlapping portions 5, 6 of the first and second planar spiral wirings 2, 3. Therefore, a direct current resistance value (Rdc) can be reduced in the innermost circumferential overlapping portions 5, 6 of the first planar spiral wiring 2 and the second planar spiral wiring 3. Thus, a direct current resistance value can be reduced in a coil composed of the first planar spiral wiring 2 and the second planar spiral wiring 3. Furthermore, in the first embodiment, as compared to FIG. 9, the innermost circumferential overlapping portions 5, 6 can be formed without changing the number of turns of the coil. Therefore, the connection-reliability can be improved and the direct current resistance value can be reduced in the coil composed of the first planar spiral wiring 2 and the second planar spiral wiring 3 without changing the number of turns. Moreover, in the first embodiment, as shown in FIG. 2, the outermost portions of the planar spiral wirings 2, 3 are not changed in terms of the position and the number of layers as compared to the configuration of FIG. 9 and thereby, the connection-reliability can be improved and the direct current resistance value can be reduced in the coil composed of the first planar spiral wiring 2 and the second planar spiral wiring 3 without substantially changing the outermost circumferential diameter, the number of layers, etc. In other words, these effects can result from substantially the same outer shape. As described above, when viewed in the laminated direction, the second planar spiral wiring 3 is wound in the direction (corresponding to the clockwise direction from the outside to the inside) different from the winding direction of the first planar spiral wiring 2 (corresponding to the counterclockwise direction from the outside to the inside). As a result, when currents flow through the first and second planar spiral wirings 2, 3, the magnetic fluxes generated are oriented to the same direction as that of the currents, so that a larger inductance (L) can be obtained as compared to a single structure of the first planar spiral wiring 2 or the second planar spiral wiring 3.

Materials used in the coil component 1 will be described. First, while the material of the first planar spiral wiring 2 and the second planar spiral wiring 3 serving as constituent elements of the coil component 1 is not particularly limited, it may be made of metal such as Cu (copper), Ag (silver), and Au (gold) in view of possibilities of a low electric resistance and a narrow pitch. While the material of the insulating layer 12 serving as a constituent element of the coil component 1 is not particularly limited, it may be made of an organic insulating material such as an epoxy-based resin, bismaleimide, liquid crystal polymer, and polyimide, or it may be made of a combination of the organic insulating material and an inorganic filler material such as a silica filler and/or an organic filler material. For example, the material of the insulating layer 12 serving as a constituent element of the coil component 1 may be made of a combination of an epoxy-based resin and a silica filler. While the material of the magnetic core part 13 and the magnetic body layer 14 serving as constituent elements of the coil component 1 is not particularly limited, it may be made of an epoxy-based resin comprising a metal magnetic material made of Fe, Si, Cr, etc. It is preferable that the magnetic core part 13 and the magnetic body layer 14 comprise 90 wt. % or more metal magnetic material made of Fe, Si, Cr, etc. in view of improvements of the inductance value and the direct current superposition characteristics. Additionally, it is preferable that the material of the magnetic core part 13 and the magnetic body layer 14 is obtained by mixing two or more metal magnetic materials different in a particle size distribution in view of an improvement of a filling property.

An example of a manufacturing method of the coil component 1 will be described with reference to FIGS. 8A to 8G.

Figure 8A:
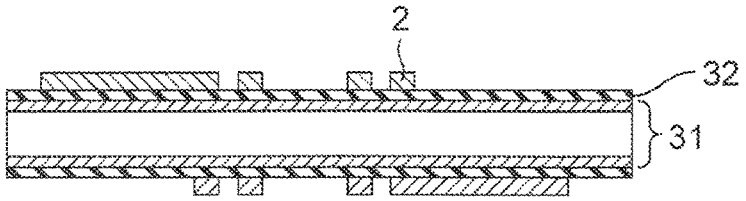
FIG. 8A is a schematic cross-sectional view of a state for forming the first planar spiral wiring on an insulating layer.

First, on both sides of a peelable and removable dummy substrate 31 (substrate with metal foil), insulating sheets are thermally press-bonded/thermally cured by using a vacuum laminator, a press apparatus, etc. to form an insulating layer 32 on both sides of the dummy substrate 31 as shown in FIG. 8A. A power feeding film is then formed on the insulating layer 32 by electroless plating, sputtering, vapor deposition, etc. Subsequently, after a photosensitive resist is applied to the power feeding film and patterned by photolithography etc., a metal wiring is formed by an electrolytic plating. After the metal wiring is formed, the photosensitive resist is peeled and removed by a chemical solution, and the power feeding film is then removed by an etching to form the first planar spiral wiring 2 on the insulating layer 32 as shown in FIG. 8A.

Figure 8B:
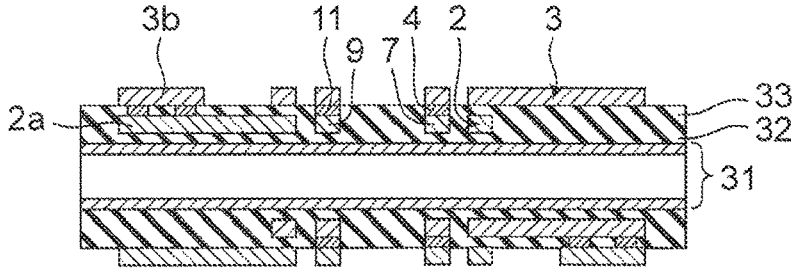
FIG. 8B is a schematic cross-sectional view of a state for forming the second planar spiral wiring on an insulating layer.

Subsequently, an insulating sheet is thermally press-bonded/thermally cured by using a vacuum laminator, a press apparatus, etc. on the insulating layer 32 to cover the first planar spiral wiring 2, thereby further forming an insulating layer 33 as shown in FIG. 8B. Through-holes are then formed in the insulating layer 33 by a laser processing etc. along the laminated direction, the through-holes respectively reaching the end part 7 at the innermost circumferential region of the first planar spiral wiring 2, the portion 9 corresponding to the position wound by a half circumference from the end part, and the outside end part of the lead part 2*a* of the first planar spiral wiring 2. A power feeding film is then formed in the through-holes and on the insulating layer 33 by electroless plating, sputtering, vapor deposition, etc. Subsequently, after a photosensitive resist is applied to the power feeding film and patterned by photolithography etc., a metal wiring is formed by the electrolytic plating. After the metal wiring is formed, the photosensitive resist is peeled and removed by the chemical solution, and the power feeding film is then removed by the etching to form the first connection via 4, the second connection via 11, the second planar spiral wiring 3 and the lead part 3*b* connected through the connection vias 4, 11 to the first planar spiral wiring 2 in the insulating layer 33 and on the insulating layer as shown in FIG. 8B.

Figure 8C:
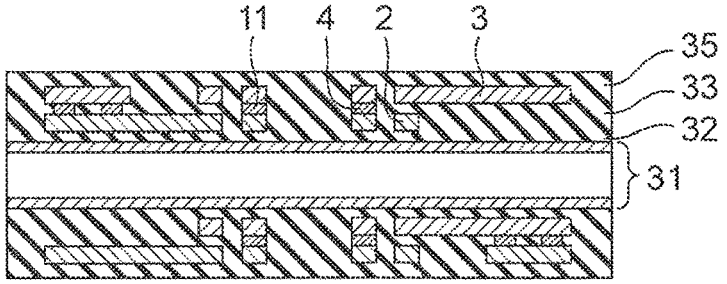
FIG. 8C is schematic cross-sectional view of a state for further forming an insulating layer covering the second planar spiral wiring.

Subsequently, an insulating sheet is disposed on the insulating layer 33 to cover the second planar spiral wiring 3, and the insulating sheet is thermally press-bonded/thermally cured by using a vacuum laminator, a press apparatus, etc., thereby further forming an insulating layer 35 as shown in FIG. 8C.

Figure 8D:
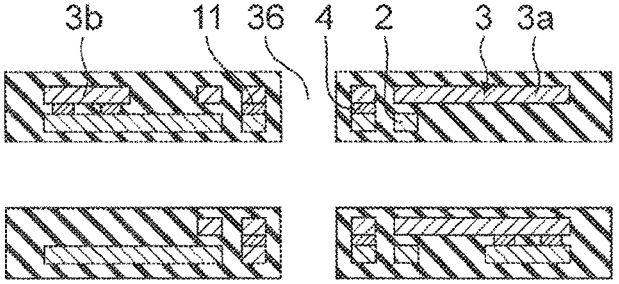
FIG. 8D is a schematic cross-sectional view of a state for forming a through-hole for disposing a magnetic core part.

Subsequently, as shown in FIG. 8D, structures including the first planar spiral wiring 2 and the second planar spiral wiring 3 are separated from the dummy substrate 31. As shown in FIG. 8D, a through-hole 36 for disposing the magnetic core part 13 is then formed in the structures including the first planar spiral wiring 2 and the second planar spiral wiring 3 by laser processing etc.

Figure 8E:
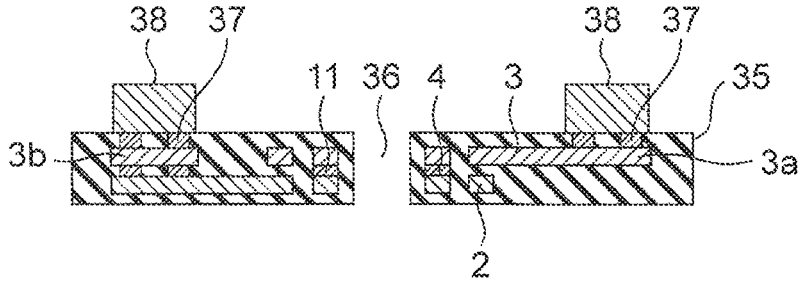
FIG. 8E is a schematic cross-sectional view of a state for forming terminals on the insulating layer.

Subsequently, through-holes are formed in the insulating layer 35 by the laser processing etc. along the laminated direction, the through-holes respectively reaching the lead part 3*b* and the outside end part of the lead part 3*a* of the second planar spiral wiring 3. A power feeding film is then formed in the through-holes and on the insulating layer 35 by electroless plating, sputtering, vapor deposition, etc. Subsequently, after a photosensitive resist is applied to the power feeding film and patterned by photolithography etc., a terminal precursor is formed by a semi-additive method. After the terminal precursor is formed, the photosensitive resist is peeled and removed by the chemical solution, and the power feeding film is then removed by the etching to form terminals 38 on the insulating layer 35 as shown in FIG. 8E, the terminals 38 being respectively electrically connected via connection vias 37 to the lead part 3*b* and the lead part 3*a* of the second planar spiral wiring 3.

Figure 8F:
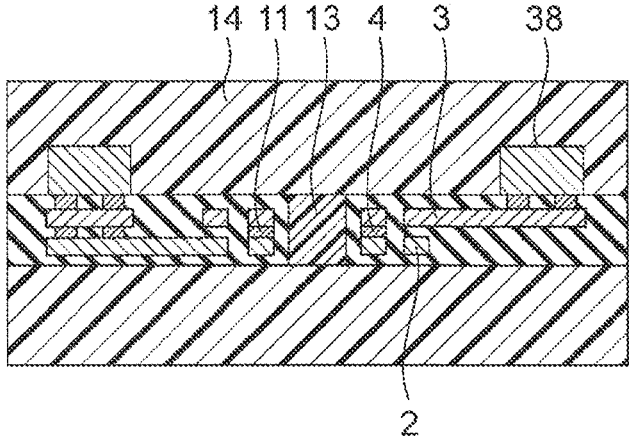
FIG. 8F is a schematic cross-sectional view of a state for forming a magnetic core part and a magnetic body layer.

Subsequently, an epoxy-based resin part comprising a metal magnetic material is disposed in the through-hole 36 and on the insulating layer 35 including the terminals 38, and the epoxy-based resin part is thermally press-bonded/thermally cured by using a vacuum laminator, press apparatus, etc. to respectively form the magnetic core part 13 and the magnetic body layer 14 as shown in FIG. 8F.

Figure 8G:
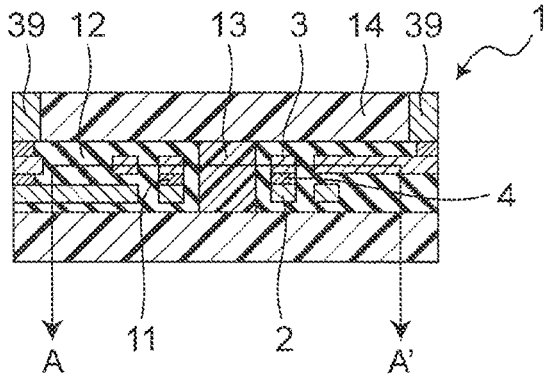
FIG. 8G is a schematic cross-sectional view of a finally obtained coil component.

Subsequently, processing such as grinding and polishing is performed to expose the terminal 38 and followed by processing such as dicing and scribing. In this processing, the terminals 38 are formed as the external terminals 39. As a result, the coil component 1 is finally obtained as shown in FIG. 8G.

Second Embodiment

A coil component related to a second embodiment according to an aspect of the present disclosure will be described with reference to FIGS. 4A and 4B.

Figure 4A:
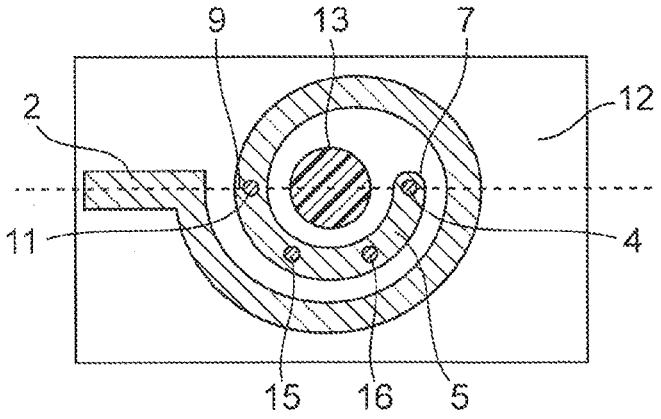
FIG. 4A is a schematic plan view of a form in which a plurality of connection vias are disposed in the innermost circumferential overlapping portion of the first planar spiral wiring.
Figure 4B:
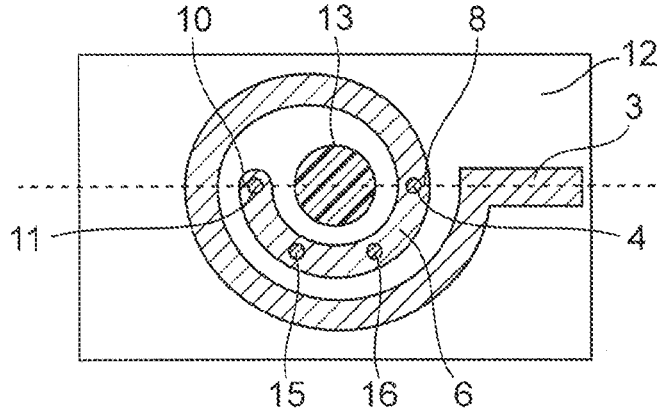
FIG. 4B is a schematic plan view of a form in which a plurality of connection vias are disposed in the innermost circumferential overlapping portion of the second planar spiral wiring.

FIG. 4A is a schematic plan view of a form in which a plurality of connection vias are disposed in the innermost circumferential overlapping portion of the first planar spiral wiring. FIG. 4B is a schematic plan view of a form in which a plurality of connection vias are disposed in the innermost circumferential overlapping portion of the second planar spiral wiring.

In second embodiment, as is the case with the first embodiment, the first planar spiral wiring 2 and the second planar spiral wiring 3 are respectively wound more than n times (n: natural number) and less than n+1 times. Therefore, each of the inner circumferential ends of the first planar spiral wiring 2 and the second planar spiral wiring 3 is located in a portion at which they are wound more than n times (n: natural number) and less than n+1 times. Specifically, in the second embodiment, as is the case with the first embodiment, the first planar spiral wiring 2 is wound 1.5 times counterclockwise from the outside to the inside as shown in FIG. 4A. The second planar spiral wiring 3 is wound 1.5 times clockwise from the outside to the inside as shown in FIG. 4B. The second planar spiral wiring 3 shown in FIG. 4B is disposed such that it is located above the first planar spiral wiring 2 shown in FIG. 4A along the laminated direction and the winding center part of the first planar spiral wiring 2 and that of the second planar spiral wiring 3 overlap with each other. The portions 5, 6 corresponding to portions respectively wound by a half circumference from the end parts 7, 10 at the innermost circumferential regions of the first planar spiral wiring 2 and the second planar spiral wiring 3 are positioned such that the distance between the first planar spiral wiring 2 and the magnetic core part 13 substantially becomes equal to the distance between the second planar spiral wiring 3 and the magnetic core part 13. Additionally, the first planar spiral wiring 2 and the second planar spiral wiring 3 respectively have width dimensions which are equal over the entire circumferences and they respectively have the width dimensions which are equal to each other. In this case, the portion 5 of the first planar spiral wiring 2 shown in FIG. 4A and the portion 6 of the second planar spiral wiring 3 shown in FIG. 4B form innermost circumferential overlapping portions substantially overlapping with each other at the innermost circumferential region when viewed in the laminated direction. Therefore, in the coil component 1 of the second embodiment, the first planar spiral wiring 2 and the second planar spiral wiring 3 also have the respective innermost circumferential overlapping portions 5, 6.

In the second embodiment, as is the case with the first embodiment, the first end part 7 of the first planar spiral wiring 2 forming one of the end parts of the innermost circumferential overlapping portion 5 is in the interconnection with the first end part 8 of the second planar spiral wiring 3 forming one of the end parts of the innermost circumferential overlapping portion 6 through the first connection via 4. The second end part 9 of the first planar spiral wiring 2 forming the other of the end parts of the innermost circumferential overlapping portion 5 is in the interconnection with the second end part 10 of the second planar spiral wiring 3 forming the other of the end parts of the innermost circumferential overlapping portion 6 through the second connection via 11. Additionally, in the second embodiment, the innermost circumferential overlapping portion 5 of first planar spiral wiring 2 between the first end part 7 and the second end part 9 is in the interconnection with the innermost circumferential overlapping portion 6 of second planar spiral wiring 3 between the first end part 8 and the second end part 10 through one or more further connection vias. For example, as shown in FIG. 4A and FIG. 4B, the innermost circumferential overlapping portion 5 of the first planar spiral wiring 2 between the first end part 7 and the second end part 9 may be further in the interconnection with the innermost circumferential overlapping portion 6 of the second planar spiral wiring 3 between the first end part 8 and the second end part 10 through a third connection via 15 and a fourth connection via 16. In other words, the innermost circumferential overlapping portion 5 of the planar spiral wiring 2 may be in the interconnection with the innermost circumferential overlapping portion 6 of the planar spiral wiring 3 through four connection vias. As a result, the connection points can be further increased as compared to the first embodiment using two connection vias. Therefore, the connection-reliability between the first planar spiral wiring 2 and the second planar spiral wiring 3 can be further improved. The third connection via 15 and the fourth connection via 16 may be further disposed by forming through-holes at positions corresponding to the third connection via 15 and the fourth connection via 16 upon the arrangements for the first connection via 4 and the second connection via 11.

Third Embodiment

A coil component related to a third embodiment according to an aspect of the present disclosure will be described with reference to FIGS. 5A and 5B.

Figure 5A:
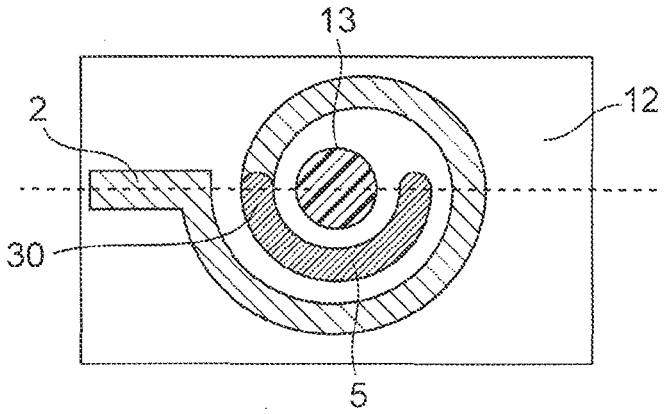
FIG. 5A is a schematic plan view of a form in which a connection via is disposed in the entire region of the innermost circumferential overlapping portion of the first planar spiral wiring.

FIG. 5A is a schematic plan view of a form in which a connection via is disposed in the entire region of the innermost circumferential overlapping portion of the first planar spiral wiring. FIG. 5B is a schematic plan view of a form in which a connection via is disposed in the entire region of the innermost circumferential overlapping portion of the second planar spiral wiring.

In the third embodiment, as is the case with the first embodiment, the first planar spiral wiring 2 and the second planar spiral wiring 3 are respectively wound more than n times (n: natural number) and less than n+1 times. Therefore, each of the inner circumferential ends of the first planar spiral wiring 2 and the second planar spiral wiring 3 is located in a portion at which they are wound more than n times (n: natural number) and less than n+1 times. Specifically, in the third embodiment, as is the case with the first embodiment, the first planar spiral wiring 2 is wound 1.5 times counterclockwise from the outside to the inside as shown in FIG. 5A. The second planar spiral wiring 3 is wound 1.5 times clockwise from the outside to the inside as shown in FIG. 5B. The second planar spiral wiring 3 shown in FIG. 5B is disposed such that it is located above the first planar spiral wiring 2 shown in FIG. 5A along the laminated direction and the winding center part of the first planar spiral wiring 2 and that of the second planar spiral wiring 3 overlap with each other. The portions 5, 6 corresponding to portions respectively wound by a half circumference from the end parts 7, 10 at the innermost circumferential regions of the first planar spiral wiring 2 and the second planar spiral wiring 3 are positioned such that the distance between the first planar spiral wiring 2 and the magnetic core part 13 substantially becomes equal to the distance between the second planar spiral wiring 3 and the magnetic core part 13. Additionally, the first planar spiral wiring 2 and the second planar spiral wiring 3 respectively have width dimensions which are equal over the entire circumferences and they respectively have the width dimensions which are equal to each other. In the above configuration, the portion 5 of the first planar spiral wiring 2 shown in FIG. 5A and the portion 6 of the second planar spiral wiring 3 shown in FIG. 5B form innermost circumferential overlapping portions substantially overlapping with each other at the innermost circumferential region when viewed in the laminated direction. Therefore, in the coil component of the third embodiment, the first planar spiral wiring 2 and the second planar spiral wiring 3 also have the respective innermost circumferential overlapping portions 5, 6.

Figure 5B:
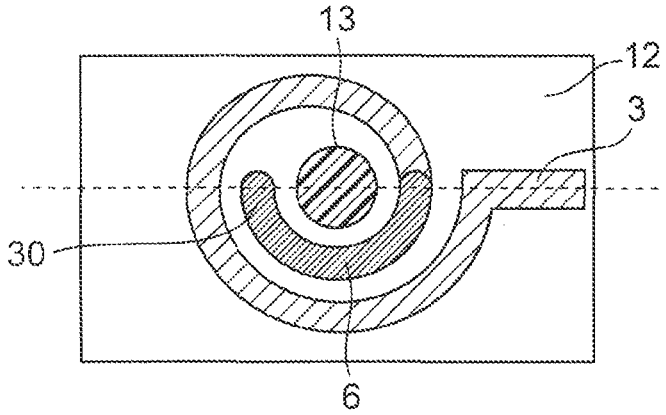
FIG. 5B is a schematic plan view of a form in which a connection via is disposed in the entire region of the innermost circumferential overlapping portion of the second planar spiral wiring.

On the other hand, in the third embodiment, unlike the first embodiment, the entire region of the innermost circumferential overlapping portion 5 of the first planar spiral wiring 2 shown in FIG. 5A is continuously in the interconnection with the entire region of the innermost circumferential overlapping portion 6 of the second planar spiral wiring 3 shown in FIG. 5B through a connection via 30. The connection via 30 is made of the same material as that of the first connection via 4 and the second connection via 11 and electrically connects the first planar spiral wiring 2 and the second planar spiral wiring 3. In other words, the connection via 30 is filled between the innermost circumferential overlapping portion 5 of the first planar spiral wiring 2 and the innermost circumferential overlapping portion 6 of the second planar spiral wiring 3. This means that the entire region of the innermost circumferential overlapping portion 5 of the first planar spiral wiring 2 is connected to the connection via 30 such that a connected region therebetween is in a shape of not "points" but "surface" while the entire region of the innermost circumferential overlapping portion 6 of the second planar spiral wiring 3 is connected to the connection via 30 such that a connected region therebetween is in a shape of not "points" but "surface". Thus, a connected region between the first planar spiral wiring 2 and the second planar spiral wiring 3 can be increased. Therefore, the connection-reliability between the first planar spiral wiring 2 and the second planar spiral wiring 3 can be further improved. The connection via 30 can be provided, by forming a through-hole with a shape extending on the innermost circumferential overlapping portion 5 of the spiral wiring 2, for example. Specifically, instead of forming the through-holes respectively reaching the end part at the innermost circumferential region of the first planar spiral wiring 2 and the portion corresponding to the position wound by a half circumference from the end part in the manufacturing method of the first embodiment described above, a through-hole is formed in the insulating layer 33 by laser processing etc., the through-hole reaching substantially the entire surface between the two end parts of the first planar spiral wiring 2. Subsequently, the through-hole is filled with a material of the connection via 30. Additionally, after the metal wiring is formed, the photosensitive resist is peeled and removed by the chemical solution, and the power feeding film is removed by etching to finally form the second planar spiral wiring 3 on the insulating layer such that the entire region of the innermost circumferential overlapping portion 5 of the first planar spiral wiring 2 is continuously in the interconnection with the entire region of the innermost circumferential overlapping portion 6 of the second planar spiral wiring 3 through the connection via 30.

A coil component related to a fourth embodiment according to an aspect of the present disclosure will be described with reference to FIGS. 6A and 6B.

Fourth Embodiment

Figure 6A:
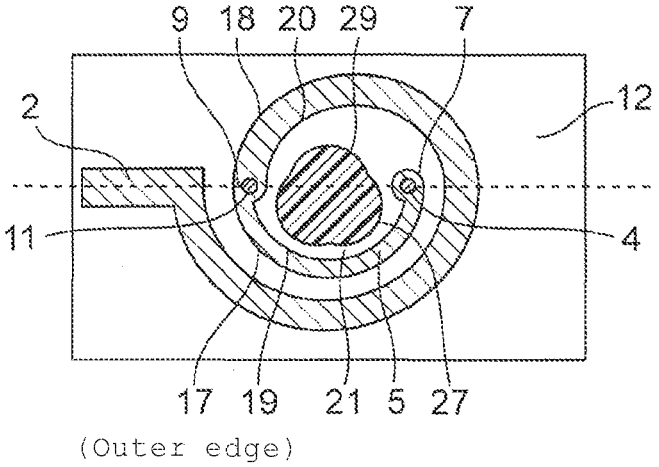
FIG. 6A is a schematic plan view of a form in which a width dimension of the innermost circumferential overlapping portion of the first planar spiral wiring is smaller than that of the portion other than the innermost circumferential overlapping portion of the first planar spiral wiring.

FIG. 6A is a schematic plan view of a form in which a width dimension of the innermost circumferential overlapping portion of the first planar spiral wiring is smaller than that of the portion other than the innermost circumferential overlapping portion of the first planar spiral wiring. FIG. 6B is a schematic plan view of a form in which a width dimension of the innermost circumferential overlapping portion of the second planar spiral wiring is smaller than that of the portion other than the innermost circumferential overlapping portion of the second planar spiral wiring.

In the fourth embodiment, as is the case with the first embodiment, the first planar spiral wiring 2 and the second planar spiral wiring 3 are respectively wound more than n times (n: natural number) and less than n+1 times. Therefore, each of the inner circumferential ends of the first planar spiral wiring 2 and the second planar spiral wiring 3 is located in a portion at which they are wound more than n times (n: natural number) and less than n+1 times. Specifically, in the fourth embodiment, as is the case with the first embodiment, the first planar spiral wiring 2 is wound 1.5 times counterclockwise from the outside to the inside as shown in FIG. 6A. The second planar spiral wiring 3 is wound 1.5 times clockwise from the outside to the inside as shown in FIG. 6B. The second planar spiral wiring 3 shown in FIG. 6B is disposed such that it is located above the first planar spiral wiring 2 along the laminated direction and the winding center part of the first planar spiral wiring 2 and that of the second planar spiral wiring 3 overlap with each other. The portions 5, 6 corresponding to portions respectively wound by a half circumference from the end parts 7, 10 at the innermost circumferential regions of the first planar spiral wiring 2 and the second planar spiral wiring 3 are positioned such that the distance between the first planar spiral wiring 2 and the magnetic core part 13 substantially becomes equal to the distance between the second planar spiral wiring 3 and the magnetic core part 13. Additionally, the first planar spiral wiring 2 and the second planar spiral wiring 3 respectively have width dimensions over the half circumferences, the width dimensions being equal to each other. In this case, the portion 5 of the first planar spiral wiring 2 shown in FIG. 6A and the portion 6 of the second planar spiral wiring 3 shown in FIG. 6B form innermost circumferential overlapping portions substantially overlapping with each other at the innermost circumferential region when viewed in the laminated direction. Therefore, in the fourth embodiment, the first planar spiral wiring 2 and the second planar spiral wiring 3 also have the respective innermost circumferential overlapping portions 5, 6.

On the other hand, in the fourth embodiment, unlike the first embodiment, as shown in FIG. 6A, the width dimension of the innermost circumferential overlapping portion 5 of the first planar spiral wiring 2 is smaller than that of the portion other than the innermost circumferential overlapping portion 5 of the first planar spiral wiring 2. Specifically, as shown in FIG. 6A, the width dimension of the innermost circumferential overlapping portion 5 of the first planar spiral wiring 2 is smaller than that of the portion other than the innermost circumferential overlapping portion 5 of the first planar spiral wiring 2, and an outer edge 17 of the innermost circumferential overlapping portion 5 of the first planar spiral wiring 2 continues without unevenness to an outer edge 18 of the portion other than the innermost circumferential overlapping portion 5 of the first planar spiral wiring 2. In this case, an inner edge 19 of the innermost circumferential overlapping portion 5 of the first planar spiral wiring 2 and an inner edge 20 of other than the innermost circumferential overlapping portion 5 of the first planar spiral wiring 2 can be made discontinuous. Therefore, a region 21 bulging outward can be formed in the insulating layer 12 at the inner edge 20 side of the innermost circumferential overlapping portion 5 of the first planar spiral wiring 2. The terms "outer edge" and "inner edge" as used herein refer to an edge at the outer circumferential side and an edge at the inner circumferential side, respectively, when the planar spiral wirings are viewed in the laminated direction.

Figure 6B:
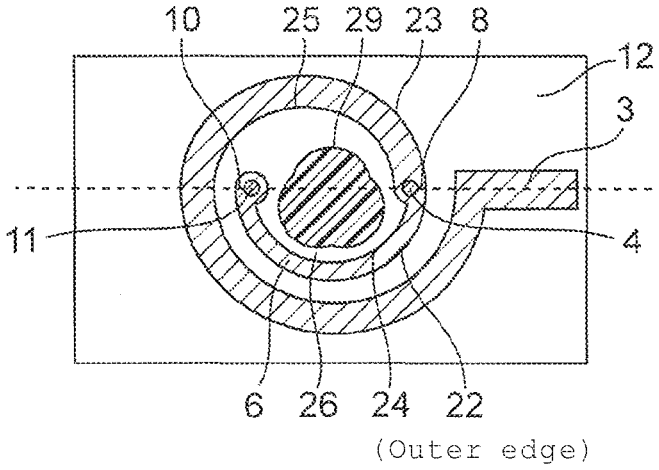
FIG. 6B is a schematic plan view of a form in which a width dimension of the innermost circumferential overlapping portion of the second planar spiral wiring is smaller than that of the portion other than the innermost circumferential overlapping portion of the second planar spiral wiring.

Similarly, as shown in FIG. 6B, the width dimension of the innermost circumferential overlapping portion 6 of the second planar spiral wiring 3 is smaller than that of the portion other than the innermost circumferential overlapping portion 6 of the second planar spiral wiring 3. Specifically, as shown in FIG. 6B, the width dimension of the innermost circumferential overlapping portion 6 of the second planar spiral wiring 3 is smaller than that of the portion other than the innermost circumferential overlapping portion 6 of the second planar spiral wiring 3, and an outer edge 22 of the innermost circumferential overlapping portion 6 of the second planar spiral wiring 3 continues without unevenness to an outer edge 23 of the portion other than the innermost circumferential overlapping portion 6 of the second planar spiral wiring 3. In this case, an inner edge 24 of the innermost circumferential overlapping portion 6 of the second planar spiral wiring 3 and an inner edge 25 of other than the innermost circumferential overlapping portion 6 of the second planar spiral wiring 3 can be made discontinuous. Therefore, a region 26 bulging outward can be formed in the insulating layer 12 at the inner edge 24 side of the innermost circumferential overlapping portion 6 of the second planar spiral wiring 3. As a result, when the second planar spiral wiring 3 is located above the first planar spiral wiring 2 along the laminated direction, the range of the magnetic core part 29 extending in a winding center part 27 of the first planar spiral wiring 2 and a winding center part 28 of the second planar spiral wiring 3 can be enlarged by the bulges of the regions 21, 26. Thus, an inductance (L) of the coil component can be increased. It is preferable that a total of the width dimension of the innermost circumferential overlapping portion 5 of the first planar spiral wiring 2 and that of the innermost circumferential overlapping portion 6 of the second planar spiral wiring 3 is made equal to or greater than the width dimensions of the portions other than the innermost circumferential overlapping portions 5, 6 of the planar spiral wirings 2, 3. In this case, as compared to FIG. 9, a reduction in the direct current resistance value can be prevented. It is preferable that the width dimension of the innermost circumferential overlapping portion 5 of the first planar spiral wiring 2 is equal to that of the innermost circumferential overlapping portion 6 of the second planar spiral wiring 3. In this case, the range of the magnetic core part 29 is not limited by the width dimension of either of the innermost circumferential overlapping portions 5, 6.

Finally, a coil component related to a fifth embodiment according to an aspect of the present disclosure will be described with reference to FIGS. 7A and 7B.

Fifth Embodiment

Figure 7A:
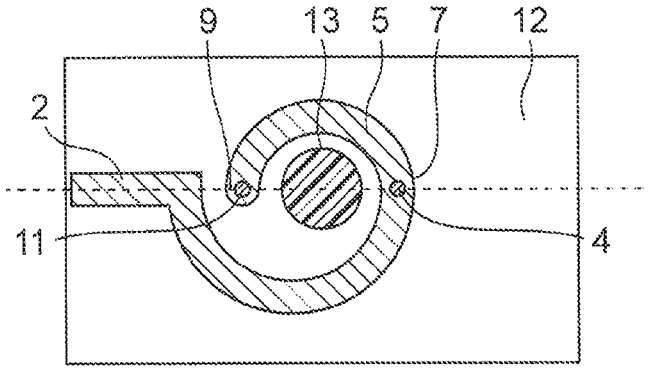
FIG. 7A is a schematic plan view of another form in which connection vias are disposed in both end parts of the innermost circumferential overlapping portion of the first planar spiral wiring.

FIG. 7A is a schematic plan view of another form in which connection vias are disposed in both end parts of the innermost circumferential overlapping portion of the first planar spiral wiring. FIG. 7B is a schematic plan view of another form in which connection vias are disposed in both end parts of the innermost circumferential overlapping portion of the second planar spiral wiring.

In the fifth embodiment, the first planar spiral wiring 2 and the second planar spiral wiring 3 are respectively wound n times. Specifically, in the fifth embodiment, the first planar spiral wiring 2 and the second planar spiral wiring 3 are respectively wound once. As shown in FIG. 7A, the first planar spiral wiring 2 is wound once counterclockwise from the outside to the inside. As shown in FIG. 7B, the second planar spiral wiring 3 is wound once clockwise from the outside to the inside. As is the case with the first to third embodiments, the magnetic core part 13 is disposed to extend in the winding center part of the first planar spiral wiring 2 and the winding center part of the second planar spiral wiring 3. The first planar spiral wiring 2 and the second planar spiral wiring 3 are disposed such that the second planar spiral wiring 3 is located above the first planar spiral wiring 2 along the laminated direction and the winding center part of the first planar spiral wiring 2 and that of the second planar spiral wiring 3 overlap with each other. The portions 5, 6 corresponding to portions respectively wound by a half circumference from the end parts 9, 8 at the innermost circumferential regions of the first planar spiral wiring 2 and the second planar spiral wiring 3 are positioned such that the distance between the first planar spiral wiring 2 and the magnetic core part 13 substantially becomes equal to the distance between the second planar spiral wiring 3 and the magnetic core part 13. Additionally, the first planar spiral wiring 2 and the second planar spiral wiring 3 respectively have width dimensions which are equal over the entire circumferences and they respectively have the width dimensions which are equal to each other.

Figure 7B:
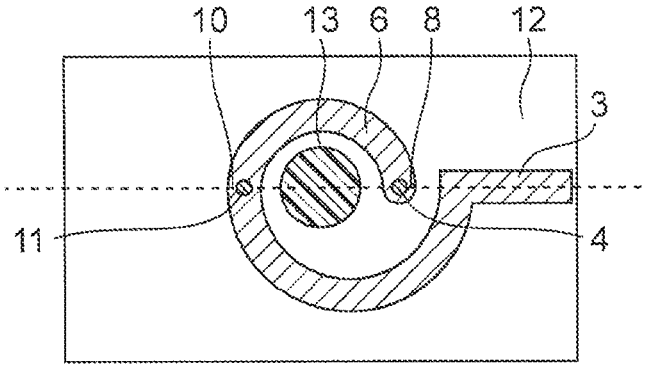
FIG. 7B is a schematic plan view of another form in which connection vias are disposed in both end parts of the innermost circumferential overlapping portion of the second planar spiral wiring.

In this configuration, the portion 5 of the first planar spiral wiring 2 shown in FIG. 7A and the portion 6 of the second planar spiral wiring 3 shown in FIG. 7B form innermost circumferential overlapping portions substantially overlapping with each other at the innermost circumferential region when viewed in the laminated direction. Therefore, in the fifth embodiment, the first planar spiral wiring 2 and the second planar spiral wiring 3 also have the respective innermost circumferential overlapping portions 5, 6.

In other words, in the fifth embodiment, one of the end parts of the respective innermost circumferential overlapping portions 5, 6 of the first planar spiral wiring 2 and the second planar spiral wiring 3 are positioned at portions wound by a half circumference from the other of the end parts of the respective innermost circumferential overlapping portions 5, 6 of the first planar spiral wiring 2 and the second planar spiral wiring 3. Therefore, as compared to the conventional form in which the inner circumferential end of the one planar spiral wiring 101 is in the interconnection with that of the other planar spiral wiring 102 through the one connection via 103 along the laminated direction, the innermost circumferential regions of the first and second planar spiral wirings 2, 3 respectively have one fourth of the circumference additionally wound at the innermost circumferential regions. Therefore, the regions of the innermost circumferential overlapping portions 5, 6 of the planar spiral wirings 2, 3 can be enlarged while ensuring the wiring distances. In this state, in the fifth embodiment, as shown in FIGS. 7A and 7B, the first end part 7 of the first planar spiral wiring 2 forming the one of the end parts of the innermost circumferential overlapping portion 5 is in the interconnection with the first end part 8 of the second planar spiral wiring 3 forming the one of the end part of the innermost circumferential overlapping portion 6 through the first connection via 4. The second end part 9 of the first planar spiral wiring 2 forming the other of the end parts of the innermost circumferential overlapping portion 5 is in the interconnection with the second end part 10 of the second planar spiral wiring 3 forming the other of the end parts of the innermost circumferential overlapping portion 6 through the second connection via 11. Therefore, the innermost circumferential overlapping portion of the planar spiral wiring 5 is in the interconnection with the innermost circumferential overlapping portion of the planar spiral wiring 6 through the two connection vias. As a result, the connection-reliability between the first planar spiral wiring 2 and the second planar spiral wiring 3 can be improved. Additionally, in the fifth embodiment, as compared to the conventional form in which the inner circumferential end of the planar spiral wiring 101 is in the interconnection with that of the planar spiral wiring 102 through one connection via 103 as shown in FIG. 9 along the laminated direction, the innermost circumferential regions of the first and second planar spiral wirings 2, 3 are extended along the respective winding directions. As a result, when viewed in the laminated direction, the planar spiral wirings 2, 3 are doubled in the innermost circumferential overlapping portions 5, 6. Additionally, the width dimensions of the innermost circumferential overlapping portions 5, 6 of the first and second planar spiral wirings 2, 3 are equal to that of the portions other than the innermost circumferential overlapping portions 5, 6 of the first and second spiral wirings 2, 3. As a result, the cross-sectional areas are substantially increased in the innermost circumferential overlapping portions 5, 6 of the first and second planar spiral wirings 2, 3. Therefore, the direct current resistance value can be reduced in the innermost circumferential overlapping portions 5,6 of the first planar spiral wiring 2 and the second planar spiral wiring 3. Thus, the direct current resistance value can be reduced in the coil composed of the first planar spiral wiring 2 and the second planar spiral wiring 3.

Although the coil component related to an aspect of the present disclosure and a manufacturing method thereof have been described, the present disclosure is not limited thereto and it will be understood that various modifications are made by those skilled in the art without departing from the scope of the disclosure defined by claims. For example, the embodiments described above may be combined as needed. In this case, the combination may be made by combining portions of the embodiments with each other.

The invention claimed is:

1. A coil component comprising:

a first planar spiral wiring; and a second planar spiral wiring located above the first planar spiral wiring in a laminated direction and electrically interconnected through connection vias to the first planar spiral wiring, wherein the second planar spiral wiring is wound in a direction different from a winding direction of the first planar spiral wiring when viewed in the laminated direction, wherein the first planar spiral wiring and the second planar spiral wiring have respective innermost circumferential overlapping portions overlapping with each other at the innermost circumferential region when viewed in the laminated direction, wherein a first end of the innermost circumferential overlapping portion of the first planar spiral wiring corresponds to an actual end of the first planar spiral wiring, and a second end of the innermost circumferential overlapping portion of the first planar spiral wiring is at a distance from the actual end of the first planar spiral wiring, wherein a first end of the innermost circumferential overlapping portion of the second planar spiral wiring corresponds to an actual end of the second planar spiral wiring, and a second end of the innermost circumferential overlapping portion of the second planar spiral wiring is at a distance from the actual end of the second planar spiral wiring, and wherein the first end of the innermost circumferential overlapping portion of the first planar spiral wiring is in an electrical interconnection with the second end of the innermost circumferential overlapping portion of the second planar spiral wiring through one of the connection vias, and the second end of the innermost circumferential overlapping portion of the first planar spiral wiring is in an electrical interconnection with the first end of the innermost circumferential overlapping portion of the second planar spiral wiring through another one of the connection vias.

2. The coil component according to claim 1, wherein the first end of the innermost circumferential overlapping portion of the first planar spiral wiring is positioned at a portion wound by a half circumference from the second end of the innermost circumferential overlapping portion of the first planar spiral winding, and the first end of the second planar spiral wiring is positioned at a portion wound by a half circumference from the second end of the innermost circumferential overlapping portion of the second planar spiral wiring.

3. The coil component according to claim 1, wherein the innermost circumferential overlapping portion of the first planar spiral wiring between the first end and the second end of the first planar spiral wiring is in the interconnection with the innermost circumferential overlapping portion of the second planar spiral wiring between the first end and the second end of the second spiral wiring through one or more further connection vias.

4. The coil component according to claim 1, wherein an entire region of the innermost circumferential overlapping portion of the first planar spiral wiring is in the interconnection with an entire region of the innermost circumferential overlapping portion of the second planar spiral wiring through a connection via.

5. The coil component according to claim 1, further comprising a magnetic core part extending in a winding center part of the first planar spiral wiring and a winding center part of the second planar spiral wiring.

6. The coil component according to claim 1, wherein a width dimension of the innermost circumferential overlapping portion of the first planar spiral wiring is smaller than a width dimension of a portion other than the innermost circumferential overlapping portion of the first planar spiral wiring, and wherein the width dimension of the innermost circumferential overlapping portion of the second planar spiral wiring is smaller than the width dimension of a portion other than the innermost circumferential overlapping portion of the second planar spiral wiring.

7. The coil component according to claim 6, wherein an outer edge of the innermost circumferential overlapping portion of the first planar spiral wiring continues without unevenness to an outer edge of the portion other than the innermost circumferential overlapping portion of the first planar spiral wiring, and wherein an outer edge of the innermost circumferential overlapping portion of the second planar spiral wiring continues without unevenness to an outer edge of the portion other than the innermost circumferential overlapping portion of the second planar spiral wiring.

* * * * *